United States Patent [19]

Gardner

[11] 4,299,351

[45] Nov. 10, 1981

[54] SIX-CELL PARTITION

[75] Inventor: Jeffrey M. Gardner, Wheaton, Ill.

[73] Assignee: Container Corporation of America, Chicago, Ill.

[21] Appl. No.: 217,801

[22] Filed: Dec. 18, 1980

[51] Int. Cl.[3] ..... B65D 5/48
[52] U.S. Cl. ..... 229/42; 229/15
[58] Field of Search ..... 229/42, 15

[56] References Cited

U.S. PATENT DOCUMENTS

| | | | |
|---|---|---|---|
| 1,815,800 | 7/1931 | Respess | 229/15 |
| 3,236,433 | 2/1966 | Barrett et al. | 229/42 |
| 3,317,111 | 5/1967 | Black | 229/42 |

*Primary Examiner*—Stephen Marcus
*Attorney, Agent, or Firm*—R. W. Carpenter; Davis Chin

[57] ABSTRACT

A partition formed of a one-piece sheet of a foldable paperboard which is divided into three sections, and, when folded into erected position, forms six cells within an outer shipping container or wrapper.

2 Claims, 4 Drawing Figures

SIX-CELL PARTITION

BACKGROUND OF THE INVENTION

1. Field of the Invention

This invention relates generally to partitions and more particularly to a partition, formed from a one piece blank of foldable sheet material such as paperboard, which can be folded to provide six internal cells within an outer shipping container or wrapper.

2. Description of the Prior Art

A state of the art search directed to the subject matter of this application uncovered the following patents:

U.S. Pat. Nos. 1,131,773; 2,154,085; 3,236,433; 3,260,440; 3,301,460; 3,317,111; 3,380,642; 3,519,191; 3,626,494; 3,738,561; 3,756,496; 3,871,569; 3,912,159; 3,912,891; 3,931,924; 3,977,592; 3,982,684; 3,985,286; 4,108,349; 4,130,235; 4,144,995; 4,157,156; 4,171,762; German Pat. No. 1,536,310; and British Pat. Nos. 399,536; 903,931; 912,424.

An examination of the above prior patents indicates that none discloses a six-cell arrangement made from a three-section blank of paperboard with the various panels of each section secured to each other and to the panels of related sections in the same manner of that disclosed in this application.

SUMMARY OF THE INVENTION

This invention relates to one-piece paperboard partition arrangements to provide a plurality of cells within an outer wrapper or shipping container.

It is an object of the invention to provide, in a partition of the type described, a device formed from a rectangular blank of paperboard having three generally similar sections which are joined to each other to form a six-cell partition.

A more specific object of the invention is the provision, in a partition device of the type described, of an arrangement which includes a center section with a pair of side sections foldably joined to and disposed on opposite sides of the center section to cooperate therewith and provide six separate cells.

These and other objects of the invention will be apparent from an examination of the following description and drawings.

THE DRAWINGS

It will be understood that, for purposes of clarity, certain elements may have been intentionally omitted from certain views, where they are believed to be illustrated to better advantage in other views.

DESCRIPTION OF THE INVENTION

Figure 1:
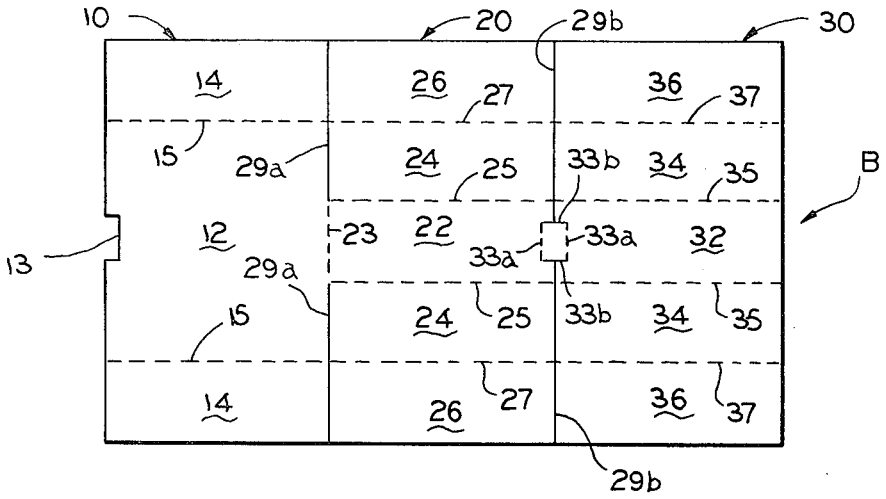
FIG. 1 is a plan view of a blank of foldable sheet material from which the partition illustrated in other views may be formed.
Figure 4:
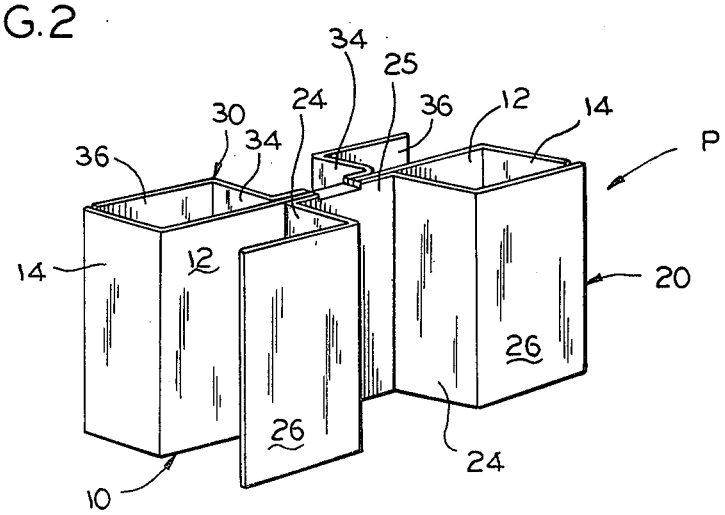
FIG. 4 is a perspective view of a completely erected partition embodying features of the invention.

Referring now to the drawings for a better understanding of the invention, it will be seen that the novel partition device, indicated generally at P in FIG. 4, may be formed from the unitary blank B of foldable sheet material such as paperboard illustrated in FIG. 1.

Figure 2:
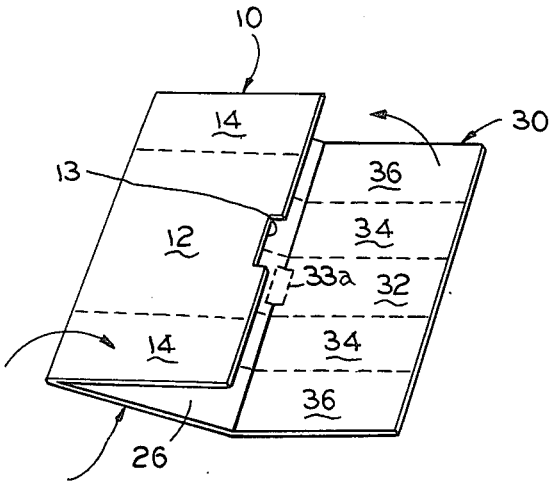
FIG. 2 is a perspective view illustrating one step in the conversion of the blank illustrated in FIG. 1 to the erected partition illustrated in FIG. 4.

Referring now to FIGS. 1 and 2, in particular, it will be seen that the partition P includes three generally rectangular sections which, in the blank form, are of substantially the same dimensions, as seen in FIG. 1. These sections, referred to as the first, second, and third sections, have been designated 10, 20 and 30, respectively.

The first or base section 10 includes a center panel 12 having a pair of end panels 14 foldably joined to opposite ends thereof along parallel foldlines 15. First section center panel 12 may also be provided along one side edge with a notch 13, the purpose of which is described later in the specification.

Second section 20 includes a center panel 22, which is only about one-third of the width of center panel 12 of the first section, and which is flanked by a pair of intermediate panels 24 which are foldably joined along foldlines 25 to opposite side edges of panel 22. Section 20 also includes a pair of outer panels 26 which are foldably joined along foldlines 27 to corresponding outer side edges of intermediate panels 24.

Third section 30 is similar to second section 20 and includes a center panel 32 which is flanked by a pair of intermediate panels 34. Panels 34 are foldably joined to opposite side edges of panel 32 along foldlines 35. Section 30 also includes a pair of outer panels 36 which are foldably joined along foldlines 37 to adjacent outer edges of intermediate panels 34. It will be noted that the center, intermediate, and outer panels of sections 20 and 30 are of substantially the same dimensions.

It will also be noted that center panel 22 of second section 20 is foldably joined along a foldline 23 to adjacent center panel 12 of first section 10. At its other side, second section panel 22 is foldably joined to center panel 32 of third section 30. The connection between panels 22 and 32 is preferably by means of a hinged score which includes a pair of parallel foldlines **33*a* interconnected by a pair of cutlines 33*b*. Still referring to FIG. 1, it will be seen that the intermediate and outer panels 24 and 26, respectively, of second section 20, are separated from the adjacent panels of first section 10 by cutlines 29*a* and from adjacent panels of third section 30 by cutlines 29*b***.

Figure 3:
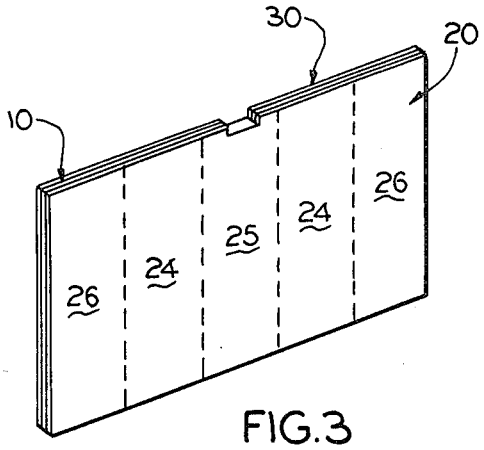
FIG. 3 is a perspective view illustrating another step in the erection of the partition.

In forming the blank B into the erected partition P, it will initially be seen that the first and second sections 10 and 20 are folded in face-to-face relation, as shown in FIG. 2. Next, third section 30 is folded over 180 degrees on top of first section 10 so as to sandwich first section 10 between second section 20 and third section 30, as shown in FIG. 3.

As best shown in FIG. 4 the material between the foldlines **33*a* and the cutlines 33*b*, which serves as a hinge joining second and third sections 20 and 30 is disposed to lie within the notch 13 of first section 10** to permit the three sections to be folded together with their center panels disposed in face-to-face relation.

In order to complete the erection of the partition all that remains to be done is to fold the intermediate panels 24 of the second section and the intermediate panels 34 of the third section outwardly so that they lie in a direction normal to the center panels to which they are attached. The outer panels 26 and 37 of second and third sections 20 and 30 are then folded back at right angles to the intermediate panels to provide the structure shown in FIG. 4. At the same time the end panels 14 are folded at right angles to center panel 12 of first section 10, with a result that the six-cell partition arrangement illustrated in FIG. 4 is formed from the substantially rectangular blank B illustrated in FIG. 1.

I claim:

1. An internal partition, formed of a unitary, generally rectangular blank of foldable paperboard, for forming six cells within an outer container or wrapper, comprising:

(a) first, second and third sections of substantially similar overall dimensions foldably joined to each other with portions of each section disposed in face-to-face relation;

(b) said first section including:

(i) a center panel;

(ii) a pair of opposed end panels foldably joined to opposed side edges of said center panel and extending normal thereto;

(c) each of said second and third sections including:

(i) a center panel;

(ii) a pair of intermediate panels foldably joined to opposed side edges of said center panel and extending normal thereto;

(iii) a pair of outer panels foldably joined to outer side edges of said intermediate panels and extending outwardly therefrom and normal thereto in parallel relation with said first section center panel.

(d) said center and outer panels of each of said second and third sections having a combined width substantially equal to that of said first section center panel.

2. A generally rectangular, unitary blank of foldable paperboard which is cut and scored to provide an internal partition, for forming six cells within an outer container or wrapper, comprising:

(a) first, second and third sections of substantially similar overall dimensions arranged in side-by-side relation with said second section flanked by the other two sections;

(b) said first section including:

(i) a center panel;

(ii) a pair of opposed end panels foldably joined to opposed side edges of said center panel;

(c) each of said second and third sections including:

(i) a center panel;

(ii) a pair of intermediate panels opposed foldably joined to side edges of said center panel;

(iii) a pair of outer panels foldably joined to outer side edges of said intermediate panels;

(d) said center and intermediate panels having a combined width substantially equal to that of said first section center panel;

(e) said second section center panel being foldably joined to adjacent center panels of said first and third sections;

(f) said second section intermediate and outer panels being separated from adjacent center and end panels of said first and third sections by cutlines.

* * * * *